US007506497B2

(12) United States Patent
Roy

(10) Patent No.: US 7,506,497 B2
(45) Date of Patent: Mar. 24, 2009

(54) ELECTRIC PROPULSION DEVICE FOR HIGH POWER APPLICATIONS

(75) Inventor: Subrata Roy, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 714 days.

(21) Appl. No.: 11/096,069

(22) Filed: Mar. 31, 2005

(65) Prior Publication Data

US 2006/0218891 A1 Oct. 5, 2006

(51) Int. Cl.
*F03H 1/00* (2006.01)

(52) U.S. Cl. ..... 60/202; 60/203.1

(58) Field of Classification Search ..... 60/204, 60/200.1, 202, 203.1
See application file for complete search history.

(56) References Cited

U.S. PATENT DOCUMENTS

| | | | | |
|---|---|---|---|---|
| 2,992,177 | A | 7/1961 | Morrisson | |
| 3,119,233 | A | 1/1964 | Wattendorf et al. | |
| 3,217,488 | A | 11/1965 | Von Ohain et al. | |
| 3,500,077 | A | 3/1970 | Post | |
| 4,815,279 | A | 3/1989 | Chang | |
| 4,821,509 | A * | 4/1989 | Burton et al. | 60/203.1 |
| 4,866,929 | A * | 9/1989 | Knowles et al. | 60/202 |
| 4,893,470 | A | 1/1990 | Chang | |
| 4,995,231 | A | 2/1991 | Smith et al. | |
| 5,367,869 | A * | 11/1994 | DeFreitas | 60/776 |
| 6,334,302 | B1 | 1/2002 | Chang-Diaz | |
| 6,449,941 | B1 * | 9/2002 | Warboys et al. | 60/202 |
| 6,619,028 | B2 * | 9/2003 | Kreiner et al. | 60/202 |
| 2002/0116915 | A1 * | 8/2002 | Hruby et al. | 60/202 |
| 2005/0086926 | A1 * | 4/2005 | King | 60/202 |

OTHER PUBLICATIONS

Roy S., P. Mikellides and D.R. Reddy, "Effective Conversion of Exit Enthalpy in a MPD Thruster," 40th *AIAA Aerospace Science Meetings*, Paper No. AIAA-2002-0917, Reno, NV, 10 pages (2002).
Pandey, B.P. and S. Roy, "An Explanation of the Sheath Instability," *Physics of Plasmas*, vol. 10, No. 1, pp. 5-9 (Jan. 2003).
Roy S., B.P. Pandey, J. Poggie and D. Gaitonde, "Modeling low pressure collisional plasma sheath with space-charge effect," *Physices of Plasmas*, vol. 10, No. 6, pp. 2578-2585 (Jun. 2003).
Roy S. and B.P. Pandey, "Development of a Finite Element Based Hall Thruster Model," *Journal of Propulsion and Power*, vol. 19, No. 5, pp. 964-971 (2003).
Roy S., "Self Consistent Electrode Model for Magnetoplasmadynamic Thrusters," 40th *AIAA/ASME.SAE/ASEE Joint Propulsion Conference*, Paper No. AIAA-2004-3469, Fort Lauderdale, Florida, 9 pages (Jul. 2004).

* cited by examiner

*Primary Examiner*—Michael Cuff
*Assistant Examiner*—Phutthiwat Wongwian
(74) *Attorney, Agent, or Firm*—Saliwanchik, Lloyd & Saliwanchik

(57) ABSTRACT

An electric propulsion device is disclosed having an anode and a cathode. The propulsion device includes a discharge annulus having the anode adjacent an end region thereof. At least one inlet aperture is adjacent the anode, the aperture(s) having propellant gas flow therethrough into the discharge annulus. The propellant gas has an ionization potential. Opposed, dielectric walls define the annulus, with at least one of the opposed dielectric walls having pores therein, the pores having cooling gas flow therethrough into the discharge annulus and substantially adjacent the opposed dielectric wall(s). The cooling gas has an ionization potential higher than the ionization energy of the propellant gas. The cooling gas is adapted to substantially prevent at least one of secondary electron emission and sputtering of the dielectric walls.

25 Claims, 3 Drawing Sheets

ELECTRIC PROPULSION DEVICE FOR HIGH POWER APPLICATIONS

STATEMENT REGARDING FEDERALLY SPONSORED RESEARCH OR DEVELOPMENT

This invention was made in the course of research partially supported by a grant from the National Aeronautics and Space Administration (NASA), Grant Numbers NAG3-2520 and NAG3-2638. The U.S. government has certain rights in the invention.

BACKGROUND

The present disclosure relates generally to electric propulsion devices, and more particularly to such devices having improved efficiency and longer lifetimes.

There is an interest in efficient, high power space propulsion engines. Hall Effect Thrusters (HETs) produce thrust by ejecting ionized matter and are popular in orbit maneuvering and attitude control of many low earth orbit (LEO) and geosynchronous earth orbit (GEO) satellites.

Currently known HETs offer specific impulses over 2400 s, thrust over 1 N, and power exceeding 50 kW at efficiencies close to 60%. However, the commercial exploitation of Hall thrusters imposes a stringent constraint of trouble-free operation for more than 8000 hours.

The walls of the discharge chamber of a stationary plasma thruster (SPT) are commonly made of composite ceramic materials, for example, boron nitride, silicate oxide, and/or the like. Among many potential reasons limiting the efficiency and lifetime of a Hall thruster, an important reason is the wear of the surface layer of the discharge chamber walls. The wall erosion of the thruster occurs primarily due to plasma-wall interactions. If the ion impact energy is sufficiently large, the impact ions may cause relatively severe, undesirable sputtering of the discharge walls, the anode, and/or the hollow cathode walls. These surfaces may then develop non-uniformities (e.g. asperities) due to the sputtering, as well as to re-deposition, cracking, etc. Further, sputtered material may, in some instances, contaminate the plasma and potentially the spacecraft surface. This may significantly affect the performance of the HET, and may potentially affect the working parameter optimization.

Although the lifetime issues are important to its design and potentially critical for long duration mission applications, many physical aspects in thruster plasma are yet to be understood. The lifetime of an on-board Hall thruster is expected to exceed several thousand hours. This complicates the experimental investigation and numerical prediction of the wall wear as several parameters come into play during the operational lifetime of the thruster. This generally results in a lack of reliable data on the sputtering yield under operational conditions.

In choosing a thruster size, one generally balances efficiency against thruster lifetime. High-energy plasma in existing technology tends to adversely interact with the walls of the thruster, as stated above. Despite significant numerical and theoretical advances of the recent past, scientists lack an adequate design to operate the Hall thruster at high power for long duration missions.

Thus, it would be desirable to provide a high efficiency and long lifetime electric propulsion device which advantageously reduces the potential for device wall erosion.

SUMMARY

An electric propulsion device is disclosed having an anode and a cathode. The propulsion device includes a discharge annulus having the anode adjacent an end region thereof. At least one inlet aperture is adjacent the anode, the aperture(s) having propellant gas flow therethrough into the discharge annulus. The propellant gas has an ionization potential. Opposed, dielectric walls define the annulus, with at least one of the opposed dielectric walls having pores therein, the pores having cooling gas flow therethrough into the discharge annulus and substantially adjacent the opposed dielectric wall(s). The cooling gas has an ionization potential higher than the ionization energy of the propellant gas. The cooling gas is adapted to substantially prevent at least one of secondary electron emission and sputtering of the dielectric walls.

BRIEF DESCRIPTION OF THE DRAWINGS

Objects, features and advantages of embodiments of the present disclosure will become apparent by reference to the following detailed description and drawings, in which like reference numerals correspond to similar, though not necessarily identical components. For the sake of brevity, reference numerals having a previously described function may not necessarily be described in connection with subsequent drawings in which they appear.

DETAILED DESCRIPTION

It has been unexpectedly and fortuitously discovered by the present inventor that cooling gas having a predetermined ionization potential and introduced through dielectric wall(s) of a HET; or cathode tip and dielectric casing of an MPD/arcjet electric propulsion device advantageously substantially thermally insulates the wall(s), thereby substantially preventing secondary electron emission (SEE) and/or shielding the wall(s) from undesirable sputtering losses. As such, embodiments of the present disclosure may substantially directly improve the efficiency and lifetime of an electric propulsion device for high power, high specific impulse applications.

Figure 1:
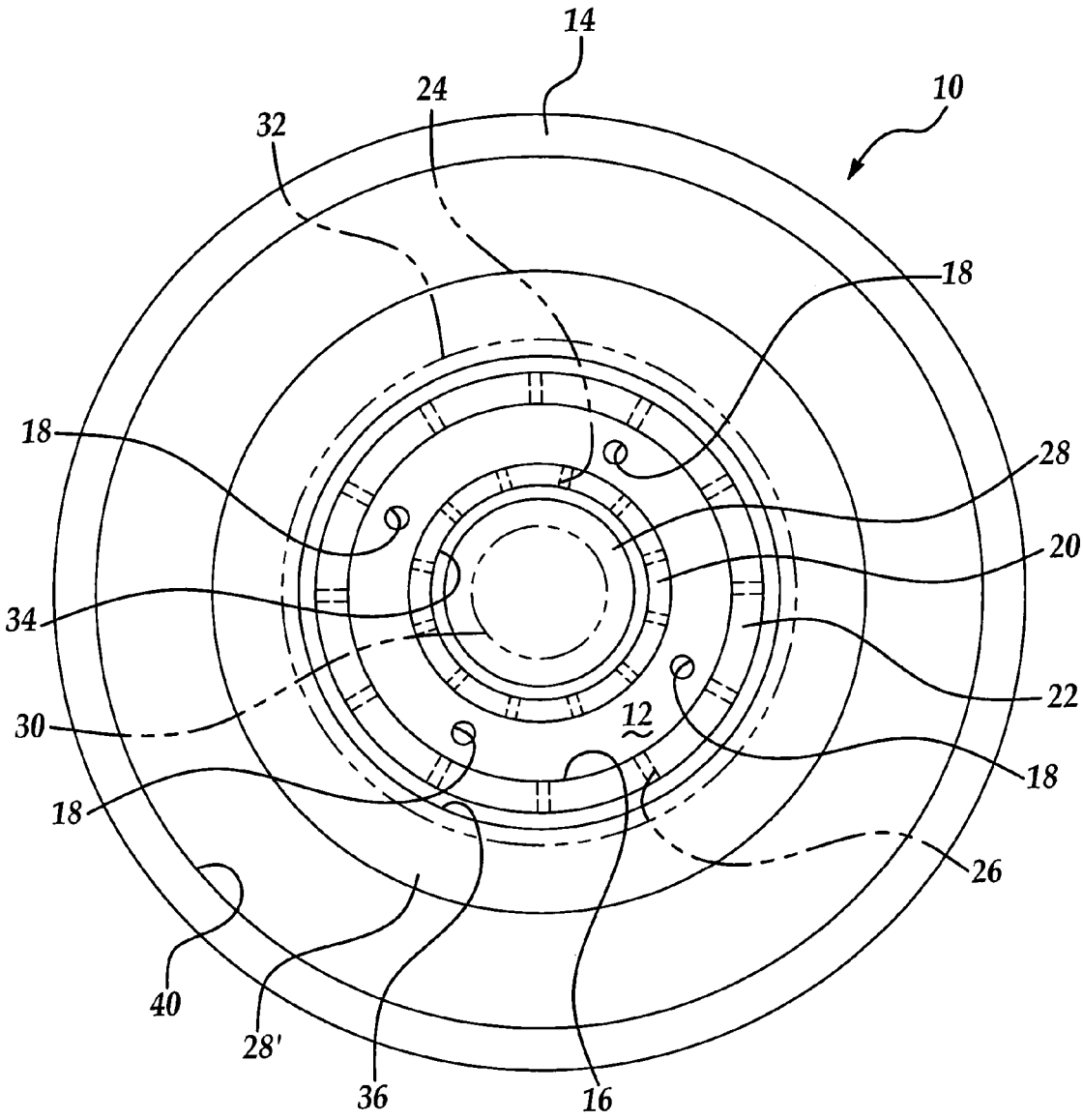
FIG. 1 is a semi-schematic end view of an embodiment of the present disclosure for use in a Hall effect thruster (HET)
Figure 2:
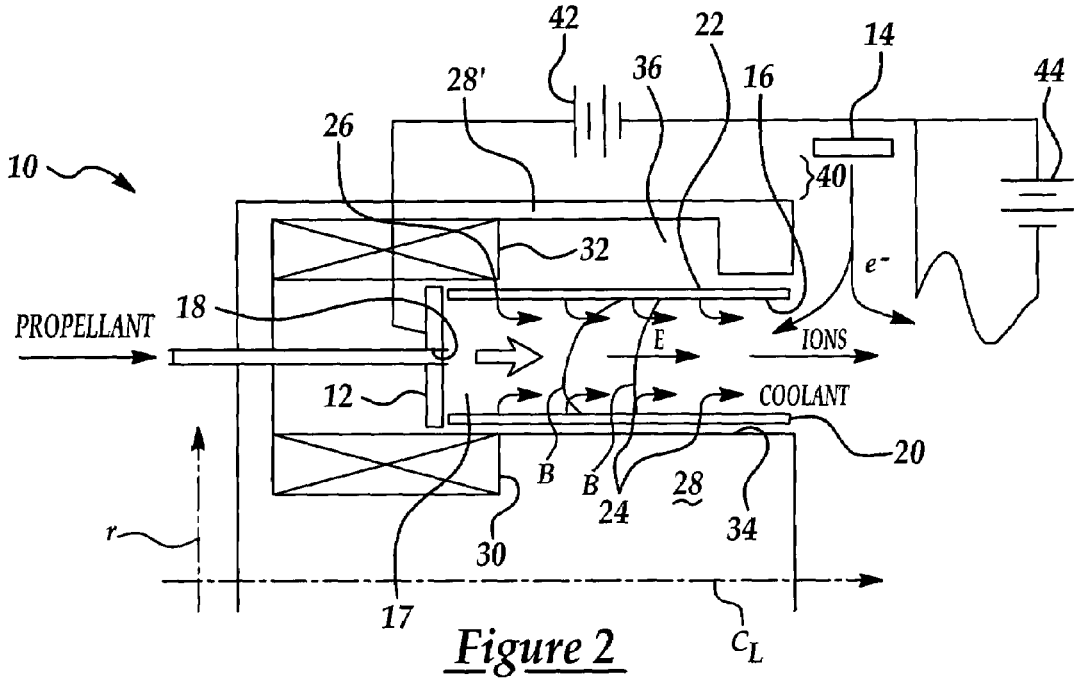
FIG. 2 is a semi-schematic, cross-sectional side view of the embodiment shown in FIG. 1.
Figure 3:
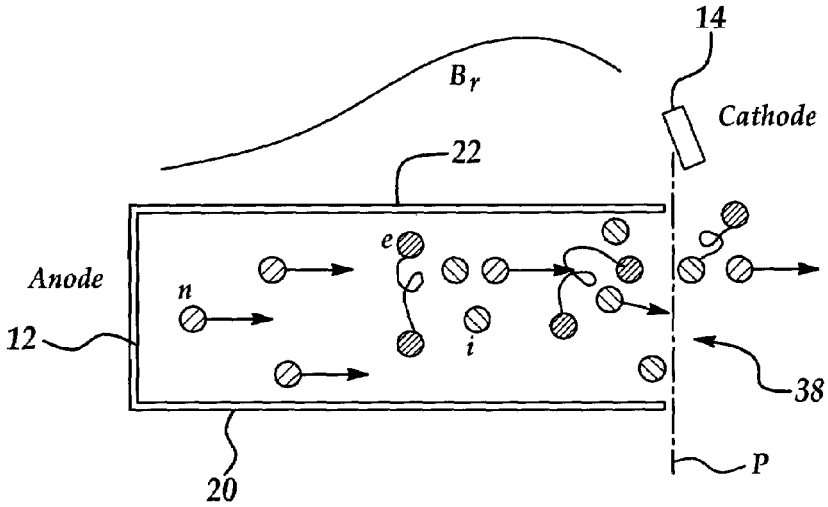
FIG. 3 is a schematic view showing a representation of the thruster plasma in the discharge annulus.

Referring now to FIGS. 1 and 2 together, an electric propulsion device/thruster according to the present disclosure is designated generally as 10. Propulsion device 10 has an anode 12 and a cathode 14. The propulsion device 10 further includes a discharge annulus/closed drift 16 having the anode 12 adjacent an end/acceleration region 17 thereof. As shown in FIG. 3, the cathode 14 may also be angularly offset from the discharge annulus 16. Having cathode 14 angularly offset from annulus 16 may advantageously reduce electron path resistance; this may be quite useful at low voltages, and may also be beneficial at high voltages.

At least one inlet aperture 18 is adjacent the anode 12. In an embodiment, aperture(s) 18 extend through the anode 12. In a further embodiment, a plurality of apertures 18 extends through the anode 12. Aperture(s) 18 are adapted to have propellant gas flow therethrough into the discharge annulus 16 (the propellant gas is schematically depicted in FIG. 2 at the large, hollow arrow inside annulus 16), the propellant gas having an ionization potential (Ei, eV). Opposed, concentric dielectric walls 20, 22 (e.g. inner dielectric wall 20 and outer dielectric wall 22) define the annulus 16. At least one of the opposed dielectric walls 20, 22 has pores 24, 26 therein. In an embodiment, and as shown in FIGS. 1 and 2, both walls 20, 22 are porous, with pores 24 defined in inner dielectric wall 20, and pores 26 defined in outer dielectric wall 22. The pores 24, 26 may be of varying sizes depending on the desired design and/or particular application. When the dielectric wall(s) 20, 22 are porous, the coolant gas may seep out from the plenums 34, 36. This may advantageously reduce the need for manufacturing of coolant throughbores in the walls 20, 22.

In an alternate embodiment, the pores 24, 26 may be throughbores (as schematically represented in FIG. 1) defined in one or both dielectric walls 20, 22. It is to be understood that the throughbores may be formed in any suitable manner (e.g. by drilling and/or the like) and have any suitable size, shape and/or configuration. In an embodiment, the throughbores/pores 24, 26 may be angled (schematically shown in FIG. 2) substantially toward an exit plane P of the discharge annulus 16 in a manner sufficient to direct the cooling gas substantially toward the exit plane P. In a further embodiment, the throughbores 24, 26 may be sized such that the center-to-center spacing of the throughbores 24, 26 is at least about ten times greater than the diameter of the throughbores.

Some of the throughbores 24, 26 may be disposed in an acceleration region 17 of the discharge annulus 16 near the anode 12, and some others of the throughbores 24, 26 may be disposed from the acceleration region 17 toward the exit plane P of the discharge annulus 16.

Plenums 34, 36 (best seen in FIG. 1), for example, may be adapted to transfer/temporarily contain coolant gas from a suitable storage reservoir (not shown) to pores/throughbores 24, 26 in dielectric walls 20, 22, respectively. It is to be understood that other suitable mechanism(s) may be used to introduce the cooling gas into the desired area (i.e. adjacent the wall(s) 20, 22 of annulus 16 or adjacent tip of cathode 14 and dielectric casing 48 (FIG. 4)). One non-limitative example of such a mechanism includes a jetting device(s) (not shown) operatively disposed in one or more throughbores 24, 26 or 50, 52 for introducing cooling gas into the desired area.

It is to be understood that walls 20, 22 (as well as guide cone/dielectric casing 48 discussed in reference to FIG. 4, below) may be made of any suitable material; however, in an embodiment, walls 20, 22 are formed from boron nitride, silicate oxide, alumina, silicon carbide, graphite, combinations thereof, and/or the like.

The pores 24, 26 are adapted to have cooling gas flow therethrough into the discharge annulus 16 and substantially adjacent one or both of the opposed dielectric walls 20, 22. The cooling gas flow is shown schematically by the curved arrows in FIG. 2 inside annulus 16. Without being bound to any theory, it is believed that the neutral cooling gas advantageously substantially prevents secondary electron emission and/or sputtering of the dielectric walls 20, 22 by substantially isolating the ionized propellant gas from the opposed dielectric walls 20, 22.

In an embodiment, the cooling gas has a first ionization potential (Ei1) higher than the first ionization potential (Ei1) of the propellant gas. In an alternate embodiment, the first ionization potential (Ei1) of the cooling gas is much higher than the first ionization potential (Ei1) of the propellant gas. As defined herein, the term "higher" means the Ei1 of the cooling gas ranges from above the Ei1 of the propellant gas to about 60% of the energy between the first and second ionization potential of the propellant gas; and the term "much higher" means the Ei1 of the cooling gas is generally above about 60% of the energy between the first and second ionization potential of the propellant gas. In another alternate embodiment, the first ionization potential (Ei1) of the cooling gas is higher than the second ionization potential (Ei2) of the propellant gas. Without being bound to any theory, it is believed that having the first ionization potential of the cooling gas higher or much higher than the first (Ei1), or higher than the second ionization potential (Ei2) of the propellant gas aids in insuring substantially no significant change in the ionization characteristic of the thruster 10. In some alternate embodiments, the first ionization potential of the cooling gas may in some instances be higher than the third ionization potential of the propellant gas.

Figure 4:
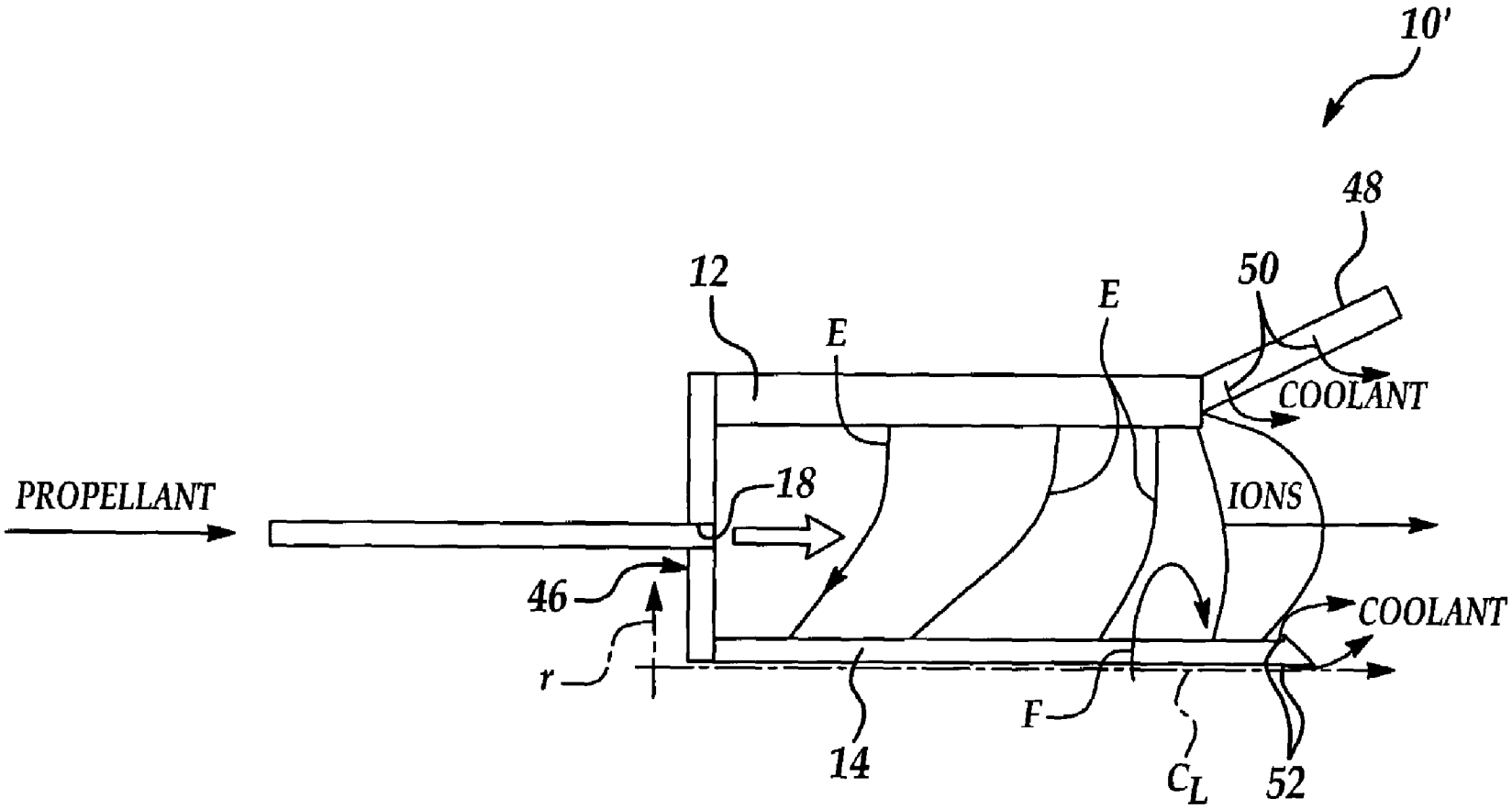
FIG. 4 is a semi-schematic, cross-sectional side view of an alternate embodiment of the present disclosure for use in an arcjet thruster or magnetoplasmadynamic (MPD) thruster.

As such, without being bound to any theory, it is believed that the use of cooling gas with a higher ionization threshold substantially avoids undesirable modification of the electromagnetic propulsion characteristics of the electric propulsion device 10, 10', for example, a HET, while substantially reducing energy loss due to erosion of the walls 20, 22 (or the tip of the cathode 14 and guide cone/dielectric casing 48 as in the embodiment of device 10' in FIG. 4). Further in the case of HET devices 10, the cooling gas may thermally insulate the HET dielectric surface(s) 20, 22 (but it does not insulate the cathode 14 in the case of HETs, as such insulation may undesirably affect the electrical performance of the HET 10), and thus not substantially affect the electrical characteristics of the HET 10 while improving the lifetime of the thruster 10.

It is to be understood that the cooling gas according to embodiment(s) herein does not manipulate ionization of the propellant gas, but rather isolates the hot propellant gas from the dielectric wall(s) 20, 22, or from the tip of cathode 14 and/or dielectric casing 48 (see FIG. 4). It is not anticipated that a significant number of charged droplets (if any) of propellant gas will be formed.

Some suitable examples of propellant/coolant pairs according to the present disclosure are as follows. Some non-limitative suitable Propellant/Coolant pairs, such as H/He, H/Ne or B/He, have substantially similar molecular weights, and the coolant Ei1 is greater than the propellant Ei2. For other suitable Propellant/Coolant pairs listed in Table 1 below, the coolant Ei1 is much greater than the propellant Ei1.

TABLE 1

| Material | Atomic weight kg/kmole | Ei1: First Ionization | Ei2: Second Ionization | Ei3: Third Ionization | Possible Coolants |
|---|---|---|---|---|---|
| Bismuth (Bi) | 208.98038 | 7.3 eV | 16.7 eV | 25.6 eV | Rn, I, N, He, Ne |

TABLE 1-continued

| Material | Atomic weight kg/kmole | Ei1: First Ionization | Ei2: Second Ionization | Ei3: Third Ionization | Possible Coolants |
|---|---|---|---|---|---|
| Iodine (I) | 126.90447 | 10.451 eV | 19.131 eV | 33 eV | He, Ne, F, Ar |
| Krypton (Kr) | 83.8 | 13.999 eV | 24.359 eV | 36.95 eV | He, Ne |
| Neon (Ne) | 20.1797 | 21.564 eV | 40.962 eV | 63.45 eV | He |
| Nitrogen (N) | 28.0134 | 14.5 eV | 29.6 eV | 47.4 eV | He, Ne |
| Hydrogen (H) | 1.00794 | 13.598 eV | | | He, F, Ne |
| Xenon (Xe) | 131.29 | 12.1 eV | 21.2 eV | 32.1 eV | He, Ne, F |
| Helium (He) | 4.002602 | 24.587 eV | 54.416 eV | | |
| Argon (Ar) | 39.948 | 15.759 eV | 27.629 eV | 40.74 eV | He, Ne |
| Fluorine (F) | 18.9984032 | 17.422 eV | 34.97 eV | 62.707 eV | He, Ne |
| Boron (B) | 10.811 | 8.298 eV | 25.154 eV | 37.93 eV | N, He, Ne, F |
| Oxygen (O) | 15.9994 | 13.618 eV | 35.117 eV | 54.934 eV | He, Ne |
| Radon (Rn) | 222 | 10.748 eV | | | He, Ne, F |

FIG. 3 is a schematic view showing a representation of the thruster plasma 38 in the discharge annulus 16. The thruster plasma 38 may be partially ionized gas, including electrons (e), ions (i) and neutral propellant gas particles (n). In such partially ionized plasma 38, elastic and inelastic processes may take place substantially simultaneously. The elastic collision involves exchange of momentum and energy between colliding particles; whereas inelastic processes like ionization, recombination, charge-exchange collision, plasma-wall interaction, secondary emission, sputtering, and the like may be responsible for redistributing the electron number density of the particles along with its momentum and energy. It is to be understood that not all of the above-mentioned processes are equally probable.

It is to be understood that the gases may be of any molecular weight; however, a higher molecular weight propellant gas results in higher thrust. It is to be understood that each of the molecular weights of the propellant gas and the cooling gas may range between about 2 kg/kmole and about 210 kg/kmole. In one embodiment, the cooling gas has a molecular weight substantially similar to the molecular weight of the propellant gas.

Upon exposure to the electric field in the discharge annulus 16, the propellant gas becomes a hot, at least partially ionized propellant gas exhibiting a temperature ranging between about 6.6 electron volts (eV) and about 29.1 eV (1 eV=11,600K≈11,300 Celsius). The ions generally bend towards the wall(s) 20, 22, thereby causing erosion/sputtering. Such erosion/sputtering is substantially and advantageously prevented, if not eliminated with the present disclosure. Further, the temperature of the hot ionized propellant gas/electrons generally rises the closer the gas gets to one of the opposed dielectric wall(s) 20, 22. For example, at about 0.05 m from a wall 20, 22, the temperature of the ionized gas/electrons is generally at the upper range of the temperature range recited above, for example, between about 15 eV and about 29 eV.

In an embodiment, the cooling gas is a neutral cooling gas having a temperature lower than the propellant gas temperature at the inlet aperture(s) 18. In an embodiment, the temperature of the cooling gas is less than about 200K. In an alternate embodiment, the temperature of the cooling gas may be up to about 500K. Without being bound to any theory, it is believed that the cooling gas forms a quasi-film to substantially protect the walls 20, 22 from the high energy mentioned above (e.g. temperatures of the ionized gas/electrons ranging between about 15 eV and about 29 eV). As such, according to the embodiments of FIGS. 1-3, hot, at least partially ionized gas flows through the discharge annulus 16 and is substantially enveloped by a substantially cold (as defined herein) neutral, cooling gas both at its outer 22 and inner 20 periphery.

It has been found that the erosion of the inner surfaces (forming annulus 16) of wall(s) 20, 22 may take place due to ion bombardment (classical erosion), as well as due to near wall electric fields (anomalous erosion). Whereas ion bombardment may give rise to small-scale prominences mostly across the incident ions, the "anomalous erosion" generally has a wavelike characteristic with a particular wavelength that shows the anomalous erosion is generally caused by sputtering due to electrons.

The wall temperature of Hall effect thruster (HET) 10 components during operation has been measured over about 1000 Kelvin. The ionized particles inside the thruster 10 may reach temperatures over tens of thousands Kelvin.

When electric propulsion device 10 is a Hall Effect Thruster (HET) or a magnetoplasmadynamic (MPD) thruster, the device 10 may further include an electromagnet (for example, inner magnet 28 and outer magnet 28') operatively disposed in the device 10 such that a magnetic field generated thereby is substantially normal to a center axis (for clarity, a line designating a center axis of annulus 16 is not shown; however, the arrow under "ions" in FIG. 2 may additionally be representative of such a center axis) of the discharge annulus 16. Referring now to FIG. 3, in an embodiment, the magnetic field has its peak magnitude substantially adjacent an exit plane P of the discharge annulus 16. This is demonstrated with the line $B_r$ designating the radial component of the magnetic field strength. The magnetic flux lines B are shown within annulus 16 in FIG. 2.

Electromagnetic coils 30, 32 are operatively disposed adjacent dielectric walls 20, 22, respectively. As best seen in FIG. 1, a gap 40 may be defined between cathode 14 and electromagnet 28'. As best seen in FIG. 2, a power supply 42 is operatively connected to the electrodes 12, 14; and a power supply 44 is operatively connected to the electromagnets 28, 28' (specifically, to the coils 30, 32 of the electromagnets 28, 28') to maintain the magnetic field. In an embodiment, the magnetic field ranges from a few hundred Gauss to a fraction of a Tesla.

In an embodiment, the viscosity of the cooling gas is greater than or equal to the viscosity of the propellant gas. In another embodiment, the viscosity of the cooling gas may be less than the viscosity of the propellant gas. For higher viscosity coolants, more power may be lost to shear; while for lower viscosity coolants, more cooling gas may be needed to cool as desired. In an example embodiment, the viscosity of the cooling gas ranges from about $10^{-6}$ N–s/m$^2$ to about $10^{-4}$ N–s/m$^2$.

The propellant gas may also have a viscosity ranging from $10^{-6}$ N–s/m$^2$ to about $10^{-4}$ N–s/m$^2$.

In an embodiment, the cooling gas has a substantially constant flow rate. Non-limitative examples of suitable flow rates may range between about 10 sccm (standard cubic centimeters per minute) and about 10,000 sccm. The flow rate of the coolant/cooling gas may generally be determined by the anode mass flow rate of the propellant, keeping in mind that the cooling gas generally remains substantially attached to the dielectric wall and may have a high molecular viscosity. The coolant mass flow rate is generally a small fraction of that of the propellant. In yet a further embodiment, the device 10 includes a mechanism, in communication with the pores 24, 26, for metering cooling gas flow based upon ion current at the opposed dielectric walls 20, 22.

The anode mass flow rate ranges from about 1 mg/s to about 1 g/s in an embodiment. For lower power applications, the mass flow rate may be reduced.

The HET electric propulsion device 10 may have a power requirement ranging from about 1 kW to about 200 kW. In MPD/arcjet thruster 10' embodiments, the power may go higher and may range up to about a few megawatts (MW). In an alternate embodiment of device 10, 10', the power may range between about 50 kW and about 200 kW. Alternately, the power may range between about 200 kW and about 1 MW.

The electric propulsion device 10 may have a specific impulse ranging from about 2000 seconds to about 6000 seconds. In another embodiment, specific impulses may be higher, for example up to about 10,000 seconds. In an alternate embodiment, the specific impulse may range between about 3000 seconds and about 5000 seconds; or the specific impulse may range between about 5000 seconds and about 8500 seconds.

Although the present disclosure may be particularly useful for improving lifetime and efficiency of HET electric propulsion devices 10, it is to be understood that the present disclosure may be useful for many electric propulsion devices, including but not limited to MPD or arcjet thrusters 10', as shown in FIG. 4. In this embodiment, the propellant gas enters through aperture(s) 18 in backplate 46, and anode 12 and cathode 14 are opposed concentric walls forming the annulus 16. The electric field is shown at E, and the induced magnetic (self) field is shown at F. Pores 50, 52 are in guide cone/dielectric casing 48 and in the tip region of cathode 14, respectively. Although not repeated here for the sake of brevity, it is to be understood that the cooling gas flow insulating dielectric casing 48 and tip region of cathode 14 through pores/throughbores 50, 52 functions similarly to the embodiment described above with walls 20, 22 and pores/throughbores 24, 26.

In conventional configurations of MPD/arcjet thrusters, the current concentration generally gives rise to a very high Joule heating at the tip of cathode 14, which results in undesirable melting of the cathode tip. Also, the dielectric guide cone 48 is generally bombarded with high energy ions, causing sputtering. In the MPD/arcjet thruster 10' of the present disclosure, it is believed that the cooling gas adjacent the guide cone 48 and the tip of cathode 14 generally greatly reduces (up to about 90%) the cathode tip temperature and sputtering of the guide cone 48.

Embodiments of the present disclosure advantageously substantially sustain a high power electric propulsion device (for example, a HET 10 or an MPD/arcjet 10') with substantially minimum wall erosion.

While several embodiments have been described in detail, it will be apparent to those skilled in the art that the disclosed embodiments may be modified. Therefore, the foregoing description is to be considered exemplary rather than limiting.

What is claimed is:

1. An electric propulsion device comprising:

an anode and a cathode; a discharge annulus having the anode adjacent an end region thereof; at least one inlet aperture adjacent the anode, the at least one inlet aperture having propellant gas flow therethrough into the discharge annulus, the propellant gas having a first ionization potential; and an inner dielectric wall and an outer dielectric wall, wherein the inner and outer walls are concentric, wherein the discharge annulus is between the inner and outer walls, at least one of the first and second dielectric walls having pores therein, the pores having cooling gas flow therethrough into the discharge annulus and substantially adjacent the at least one of the first and second dielectric walls, the cooling gas having a first ionization potential higher than the first ionization potential of the propellant gas, the cooling gas adapted to substantially prevent at least one of secondary electron emission and sputtering of the dielectric walls.

2. The electric propulsion device according to claim 1, wherein the device is an arcjet thruster.

3. The electric propulsion device according to claim 1, further comprising an electromagnet operatively disposed in the device such that a magnetic field generated thereby is substantially normal to a center axis of the discharge annulus, the magnetic field having its peak magnitude substantially adjacent an exit plane of the discharge annulus.

4. The electric propulsion device according to claim 3, wherein the device is a Hall Effect Thruster (HET).

5. The electric propulsion device according to claim 1, wherein the propellant gas has a molecular weight, and wherein the cooling gas has a molecular weight substantially similar to the molecular weight of the propellant gas.

6. The electric propulsion device according to claim 5, wherein each of the molecular weights of the propellant gas and the cooling gas ranges from about 2 kg/kmole to about 210 kg/kmole.

7. The electric propulsion device according to claim 1, wherein each of the propellant gas and the cooling gas have a first ionization potential and a second ionization potential, and wherein the first ionization potential of the cooling gas is higher than the second ionization potential of the propellant gas.

8. The electric propulsion device according to claim 1, wherein each of the propellant gas and the cooling gas has a viscosity, and wherein the viscosity of the cooling gas is greater than or equal to the viscosity of the propellant gas.

9. The electric propulsion device according to claim 8, wherein the viscosity of the cooling gas ranges from about $10^{-6}$ N–s/m$^2$ to about $10^{-4}$ N–s/m$^2$.

10. The electric propulsion device according to claim 1, wherein the anode mass flow rate ranges from about 1 mg/s to about 1 g/s.

11. The electric propulsion device according to claim 1, wherein the pores are defined in each of the first and second dielectric walls.

12. The electric propulsion device according to claim 1, wherein the pores comprise throughbores defined in the at least one of the first and second dielectric walls, the throughbores being angled substantially toward an exit plane of the discharge annulus in a manner sufficient to direct the cooling gas substantially toward the exit plane.

13. The electric propulsion device according to claim 12, wherein some of the throughbores are disposed in an acceleration region of the discharge annulus near the anode, and some others of the throughbores are disposed from the acceleration region toward the exit plane of the discharge annulus.

14. The electric propulsion device according to claim 1, wherein the cooling gas substantially thermally insulates the at least one of the first and second, dielectric walls.

15. The electric propulsion device according to claim 1, wherein the device has a power requirement ranging from about 1 kW to about 200 kW.

16. The electric propulsion device according to claim 1, wherein the device has a specific impulse ranging from about 2000 seconds to about 10000 seconds.

17. The electric propulsion device according to claim 1, wherein the at least one aperture extends through the anode.

18. The electric propulsion device according to claim 1, wherein there is a plurality of apertures extending through the anode.

19. The electric propulsion device according to claim 1, wherein the propellant gas has a temperature and becomes an ionized propellant gas in the discharge annulus; and wherein the cooling gas is a neutral cooling gas having a temperature lower than the propellant gas temperature at the at least one inlet aperture.

20. The electric propulsion device according to claim 19, wherein the neutral cooling gas substantially isolates the ionized propellant gas from the first and second dielectric walls.

21. The electric propulsion device according to claim 1, wherein the cooling gas has a substantially constant flow rate.

22. The electric propulsion device according to claim 1, further comprising means, in communication with the pores in the at least one of the first and second dielectric walls, for metering cooling gas flow based upon ion current at the first and second dielectric walls.

23. A Hall Effect Thruster (HET) electric propulsion device comprising: an anode and a cathode; a discharge annulus having the anode adjacent an end region thereof; at least one inlet aperture adjacent the anode, the at least one inlet aperture having propellant gas flow therethrough into the discharge annulus, the propellant gas having a first ionization potential; an inner dielectric wall and an outer dielectric wall, wherein the inner and outer walls are concentric, wherein the discharge annulus is between the inner and outer walls, at least one of the first and second dielectric walls having pores therein, the pores having cooling gas flow therethrough into the discharge annulus and substantially adjacent the at least one of the first and second dielectric walls, the cooling gas having a first ionization potential higher than the first ionization potential of the propellant gas, the cooling gas adapted to substantially prevent at least one of secondary electron emission and sputtering of the dielectric walls, wherein the cooling gas substantially thermally insulates the at least one of the first and second dielectric walls; and an electromagnet operatively disposed in the device such that a magnetic field generated thereby is substantially normal to a center axis of the discharge annulus, the magnetic field having its peak magnitude substantially adjacent an exit plane of the discharge annulus.

24. An electric propulsion device comprising:

an anode and a cathode; a discharge annulus having the anode adjacent an end region thereof; at least one inlet aperture adjacent the anode, the at least one inlet aperture adapted to have propellant gas flow therethrough into the discharge annulus, the propellant gas having a first ionization potential; and an inner dielectric wall and an outer dielectric wall, wherein the inner and outer walls are concentric, wherein the discharge annulus is between the inner and outer walls, at least one of the first and second dielectric walls having pores therein, the pores adapted to have cooling gas flow therethrough into the discharge annulus and substantially adjacent the at least one of the first and second dielectric walls, the cooling gas having a first ionization potential higher than the first ionization potential of the propellant gas, the cooling gas adapted to substantially prevent at least one of secondary electron emission and sputtering of the at last one of the first and second dielectric walls.

25. The electric propulsion device according to claim 3, wherein the device is a magnetoplasmadynamic (MPD) thruster.

* * * * *

UNITED STATES PATENT AND TRADEMARK OFFICE

CERTIFICATE OF CORRECTION

PATENT NO. : 7,506,497 B2
APPLICATION NO. : 11/096069
DATED : March 24, 2009
INVENTOR(S) : Subrata Roy It is certified that error appears in the above-identified patent and that said Letters Patent is hereby corrected as shown below:

Column 10,
Lines 36-37, "of the at last one" should read --of the at least one--.

Signed and Sealed this

Second Day of June, 2009

JOHN DOLL
*Acting Director of the United States Patent and Trademark Office*